US006282993B1

(12) United States Patent
Forman et al.

(10) Patent No.: US 6,282,993 B1
(45) Date of Patent: Sep. 4, 2001

(54) RATCHET MECHANISM FOR A RATCHET TOOL

(75) Inventors: Msrk A. Forman, Phoenix, AZ (US); Learng See-Bang, Taichung (TW)

(73) Assignees: Tseng Shu-Ying; Yu Hua-Rung, both of (TW)

( * ) Notice: Subject to any disclaimer, the term of this patent is extended or adjusted under 35 U.S.C. 154(b) by 0 days.

(21) Appl. No.: 09/596,614

(22) Filed: Jun. 19, 2000

(51) Int. Cl.[7] ..... B25B 13/46
(52) U.S. Cl. ..... 81/63.2; 81/63
(58) Field of Search ..... 81/63, 63.1, 63.2

(56) References Cited

U.S. PATENT DOCUMENTS 1,078,059 * 11/1913 Mossberg ..... 81/63
1,635,102 * 7/1927 Watson ..... 81/63
2,185,002 * 12/1939 Pack ..... 81/63
2,735,324 * 2/1956 Goldwater et al. ..... 81/60
3,019,682 * 2/1962 Hare ..... 81/63.2
4,703,676 * 11/1987 Mayer ..... 81/63
4,986,147 * 1/1991 Cooper ..... 81/63.2
5,794,496 * 8/1998 Arnold ..... 81/63.2

* cited by examiner

*Primary Examiner*—Derris H. Banks
*Assistant Examiner*—David B. Thomas
(74) *Attorney, Agent, or Firm*—Charles E. Baxley, Es

(57) ABSTRACT

A ratchet tool a shank and a head which has a hole and a recess is defined in an inside of the hole. Two identical plates are respectively connected to two sides of the head and each plate has a ring portion engaged with the hole. A ring member with a toothed outer periphery is received in the hole of the head and retained by the two ring portions. A tongue portion extends from each the ring portion and is engaged with the recess. A slot and an aperture are respectively defined through the tongue portion. The ring member has a polygonal inside to be engaged with an object. A pawl member is received in the recess and has a curved toothed surface which is engaged with the ring member. A protrusion extends from a top of the pawl member and is movably received in the slot. A pushing member is movably engaged with a second end of the pawl member and an elongated hole is defined in the pushing member. A pin extends through the two apertures in the two plates and the elongated hole. The pawl member is pushed to engaged with the ring member and positioned by the pushing member.

5 Claims, 4 Drawing Sheets

RATCHET MECHANISM FOR A RATCHET TOOL

FIELD OF THE INVENTION

The present invention relates to a ratchet mechanism of a ratchet tool and the head of the ratchet tool has a simple structure so that the ratchet mechanism is easily assembled and installed in the head of the ratchet tool.

BACKGROUND OF THE INVENTION

A conventional ratchet tool generally includes a shank and a head that is connected to an end of the shank. A ratchet mechanism is received in the head so as to perform the desired function. The head has many stepped shoulder portions to let the parts of the ratchet mechanism be engaged with the stepped shoulder portions. In order to manufacture the stepped shoulder portions, at least three different machines or manufacturing processes are needed to finish it. The first one is to manufacture the body of the head by way of forging or the like, the second one is to define different stepped shoulder portions by lathe, and the third one is to drill holes in the head by a drilling machine. The manufacturing processes obviously builds a high manufacturing cost. Besides, a lot of parts are needed to be assembled to be the ratchet mechanism and the more number of the parts is needed, the higher possibilities that the parts could be lost during assembling the tool.

The present invention intends to provide a ratchet tool that has a head with a simple structure so that the manufacturing cost is reduced and the number of parts that compose the ratchet mechanism is few.

SUMMARY OF THE INVENTION

In accordance with one aspect of the present invention, there is provided a ratchet tool and comprising a shank and a head which has a hole and a recess is defined in an inside of the hole. Two identical plates are respectively connected to two sides of the head and each plate has a ring portion engaged with the hole. A tongue portion extends from each the ring portion and is engaged with the recess. A slot and an aperture are respectively defined through the tongue portion. A ring member is rotatably received in the hole in the head and the ring member has a toothed outer periphery. The ring member has a polygonal inside. A pawl member is received in the recess and has a curved toothed surface defined in a first end of the pawl member. A protrusion extends from a top of the pawl member and the protrusion is movably received in the slot. A pushing member is movably engaged with a second end of the pawl member and an elongated hole is defined in the pushing member. A pin extends through the two apertures in the two plates and the elongated hole.

The object of the present invention is to provide a ratchet tool that has a head with simple structure which is easily to be manufactured.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
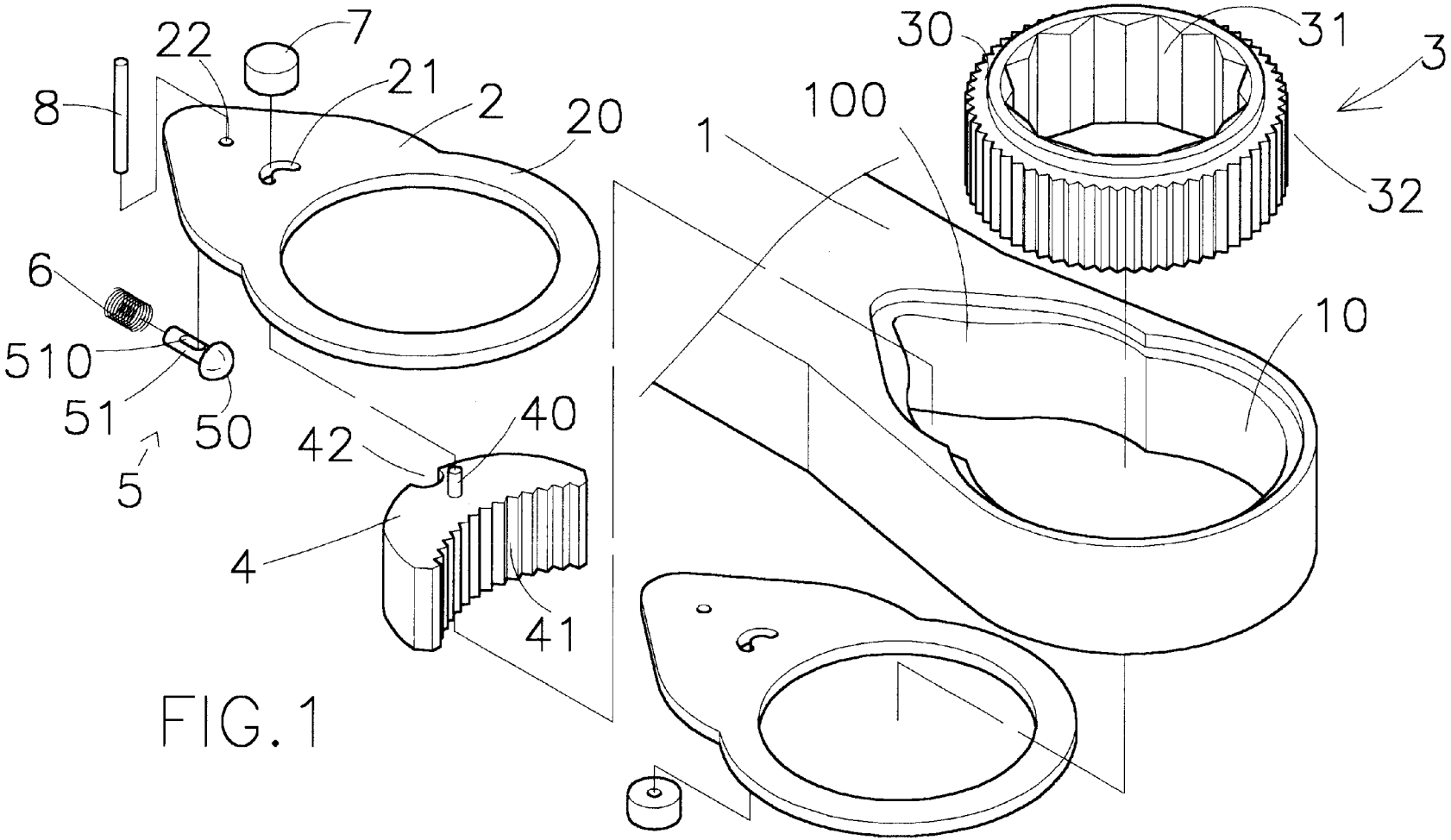
FIG. 1 is an exploded view to show a ratchet mechanism and a head of a ratchet tool of the present invention.
Figure 2:
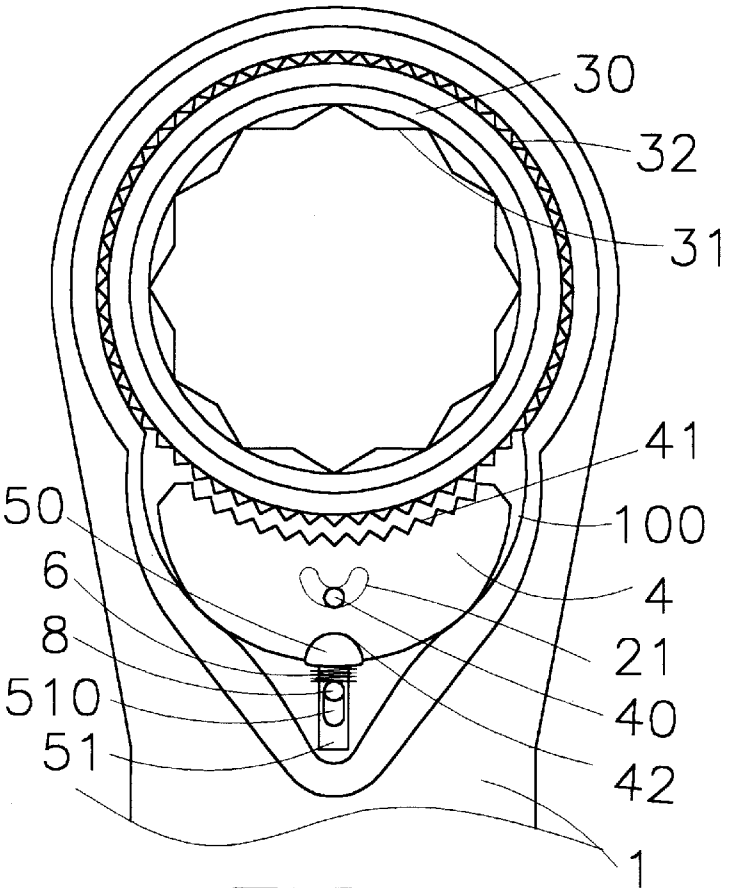
FIG. 2 is a plan view to show when the protrusion of the pawl member is located at a mediate position of the slot and the pawl member is not engaged with the ring member.
Figure 5:
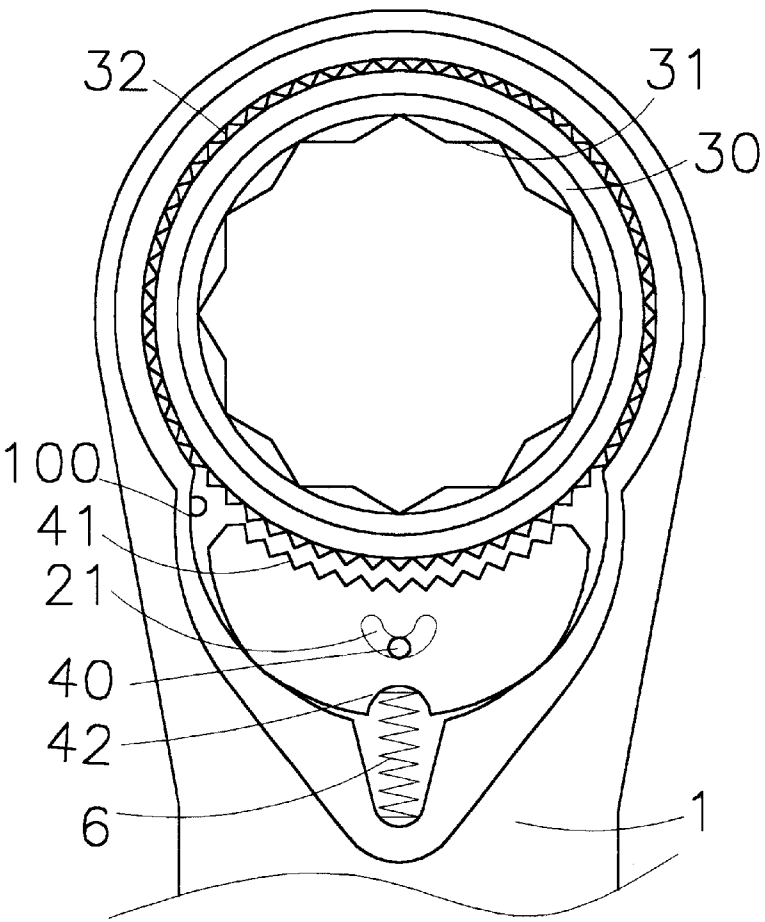
FIG. 5 is a plan view to show another embodiment of the ratchet tool when the protrusion of the pawl member is located at a mediate position of the slot and the pawl member is not engaged with the ring member.

Referring to FIGS. 1 and 2, the ratchet tool in accordance with the present invention comprises a shank 1 and a head connected to an end of the shank 1. The head has a hole 10 to form a ring-shaped portion and a recess 100 is defined in an inside of the hole 10. Two identical plates 2 are respectively connected to two sides of the head and each plate 2 has a ring portion 20 engaged with the hole 10. A tongue portion extends from each the ring portion 20 and is engaged with the recess 100. A curved slot 21 and an aperture 22 are respectively defined through the tongue portion. The slot 21 can also be a V-shaped slot or U-shaped. A ring member 3 is rotatably received in the hole 10 in the head and the ring member 3 has a toothed outer periphery 32. The ring member 3 has a polygonal inside 31 so as to mount on an object. The ring member 3 has two annular flanges 30 on two sides thereof and the two annular flanges 30 are respectively engaged with the ring portions 20 of the two plates 2. A pawl member 4 is received in the recess 100 and has a curved toothed surface 41 defined in a first end of the pawl member 4. The curved toothed surface 41 faces the ring member 3. A protrusion 40 extends from each of a top of the pawl member 4 and a bottom of the pawl member 4, only one protrusion 40 is shown. The protrusions 40 are movably received in the two slots 21 in the two plates 2 and each protrusion 40 has a knob 7 mounted thereto so that a user may hold the knob 7 to control the pawl member 4. A dent 42 is defined in the second end of the pawl member 4. The second end of the pawl member 4 is located opposite to the curved toothed surface 41.

A pushing member 5 has an enlarged rounded head 50 on a first end thereof and a shank portion 51 is connected to the enlarged rounded head 50. The enlarged rounded head 50 is engaged with the dent 42 in the second end of the pawl member 4. A second end of the pushing member 5 is engaged with an inside of the recess 100. An elongated hole 51 is defined in the pushing member 5 and a pin 8 extends through the two apertures 22 in the two plates 2 and the elongated hole 51. A spring 6 is mounted to the shank portion 51 and biased between the rounded head 50 and the pin 8.

When the protrusion 40 of the pawl member is located at a mediate position of the slot 21 as shown in FIG. 2, the pawl member 4 is located at a position wherein the pawl member 4 is not engaged with the ring member.

Figure 3:
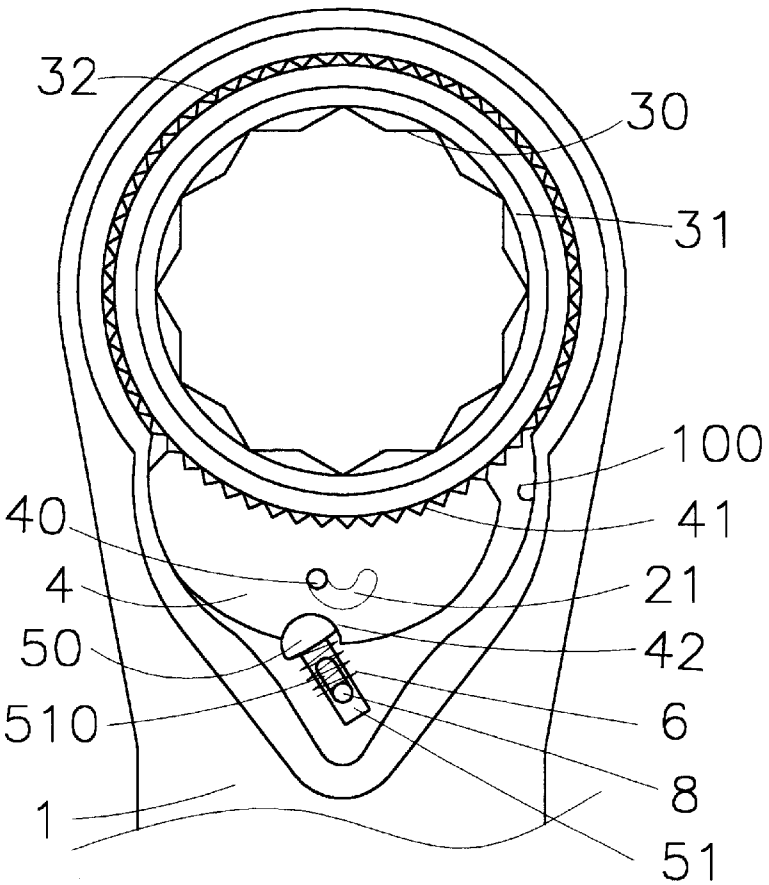
FIG. 3 is a plan view to show when the protrusion of the pawl member is located at a left end of the slot and the pawl member is engaged with the ring member.
Figure 4:
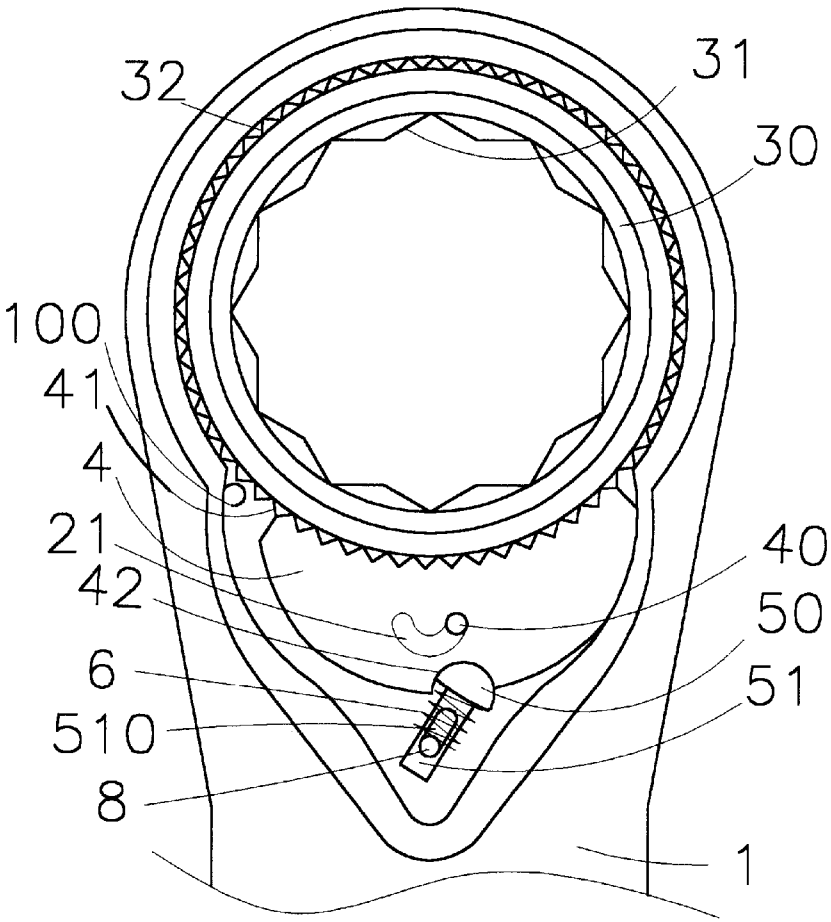
FIG. 4 is a plan view to show when the protrusion of the pawl member is located at a right end of the slot and the pawl member is engaged with the ring member.
Figure 7:
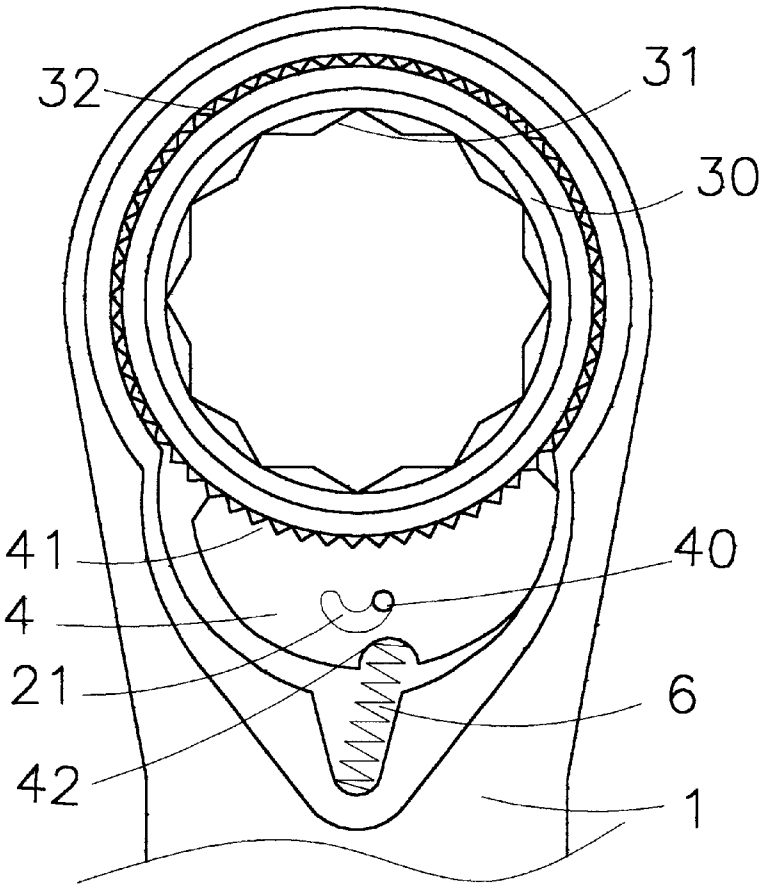
FIG. 7 is a plan view to show when the protrusion of the pawl member is located at a right end of the slot and the pawl member is engaged with the ring member.
Figure 6:
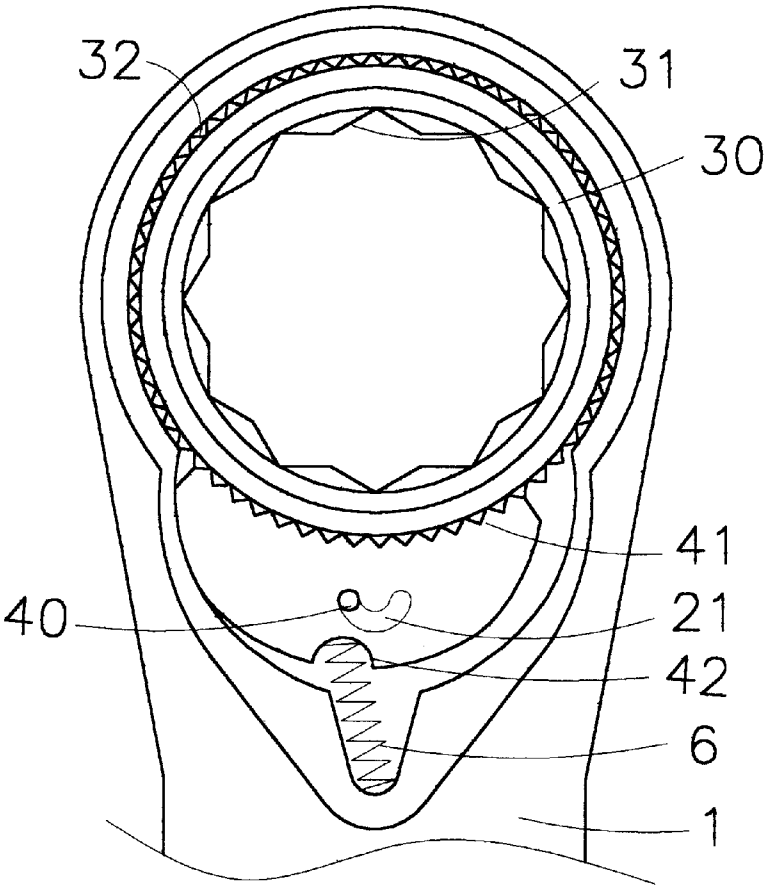
FIG. 6 is a plan view to show when the protrusion of the pawl member is located at a left end of the slot and the pawl member is engaged with the ring member.

As shown in FIG. 3, when the protrusion 40 of the pawl member 4 is pushed to a left end of the slot 21, the pawl member 4 is moved to engage with the toothed outer periphery 32 of the ring member 3. As shown in FIG. 4, when the protrusion 40 of the pawl member 4 is pushed to a right end of the slot 21, the pawl member 4 is moved to engage with the toothed outer periphery 32 of the ring member 3. The engagement of the pawl member 4 and the ring member 3 at different directions will cause different ratcheting functions.

FIGS. 4 to 7 show another embodiment of the ratchet tool wherein the pushing member 5 is replaced by a spring 6 which is biased between the dent 42 and an inside defining the recess 100. The spring 6 pushes the pawl member 4 is position and ensures the pawl member 4 to be engaged with the ring member 3.

While we have shown and described various embodiments in accordance with the present invention, it should be clear to those skilled in the art that further embodiments may be made without departing from the scope and spirit of the present invention.

What is claimed is:

1. A ratchet tool comprising:

a shank and a head connected to an end of said shank, said head having a hole and a recess defined in an inside of said hole, two identical plates respectively connected to two sides of said head and each plate having a ring portion engaged with said hole, a tongue portion extending from each said ring portion and engaged with said recess, a slot and an aperture respectively defined through said tongue portion;

a ring member rotatably received in said hole in said head and said ring member having a toothed outer periphery, said ring member having a polygonal inside, a pawl member received in said recess and having a curved toothed surface defined in a first end of said pawl member, said curved toothed surface facing said ring member, a protrusion extending from a top of said pawl member and said protrusion movably received in said slot, and a pushing member having a first end thereof engaged with a second end of said pawl member, a second end of said pushing member engaged with an inside of said recess, said second end of said pawl member located opposite to said curved toothed surface, an elongated hole defined in said pushing member and a pin extending through said two apertures in said two plates and said elongated hole.

2. The ratchet tool as claimed in claim 1, wherein said pushing member includes an enlarged rounded head and a shank portion is connected to said enlarged rounded head, said elongated hole defined through said shank portion, a spring mounted to said shank portion and biased between said rounded head and said pin, a dent defined in said second end of said pawl member and said enlarged rounded head engaged with said dent.

3. The ratchet tool as claimed in claim 1 wherein said slot is a curved slot.

4. The ratchet tool as claimed in claim 1, wherein said ring member has two annular flanges on two sides thereof and said two annular flanges are respectively engaged with said ring portions of said two plates.

5. The ratchet tool as claimed in claim 1 further comprising a knob mounted to said protrusion extending from said slot.

* * * * *